US005379937A

United States Patent [19]

Rothe

[11] Patent Number: 5,379,937

[45] Date of Patent: Jan. 10, 1995

[54] NUCLEATOR ASSEMBLY FOR SNOWMAKING APPARATUS

[75] Inventor: Charles E. Rothe, Saugerties, N.Y.

[73] Assignee: Rothe Welding and Fabrication, Inc., Saugerties, N.Y.

[21] Appl. No.: 181,799

[22] Filed: Jan. 18, 1994

[51] Int. Cl.[6] ..... F25C 3/04

[52] U.S. Cl. ..... 239/14.2; 239/135

[58] Field of Search ..... 239/14.2, 2.2, 133, 239/135

[56] References Cited

U.S. PATENT DOCUMENTS

| | | | |
|---|---|---|---|
| 3,298,612 | 1/1967 | Torrens | 239/14.2 |
| 3,408,005 | 10/1968 | Struble et al. | 239/14.2 |
| 3,567,116 | 3/1971 | Lindlof | 239/14.2 |
| 3,733,029 | 5/1973 | Eustis et al. | 239/14.2 |
| 3,945,567 | 3/1976 | Rambach | 239/14.2 |
| 4,083,492 | 4/1978 | Dewey | 239/135 X |
| 4,813,598 | 3/1989 | Kosik, Sr. et al. | 239/14.2 X |
| 4,850,705 | 7/1989 | Horner | 366/339 |
| 5,167,367 | 12/1992 | Vanderkelen et al. | 239/14.2 X |
| 5,180,106 | 1/1993 | Handfield | 239/14.2 |

*Primary Examiner*—Andres Kashnikow
*Assistant Examiner*—Lesley D. Morris
*Attorney, Agent, or Firm*—Charles J. Brown

[57] ABSTRACT

A nucleator assembly for snowmaking apparatus wherein body elements or vanes are disposed in a tubular housing, preferably radially, downstream from an air displacement mechanism and define mixing chambers in which air and water are mixed and then ejected from nozzles on the body elements or vanes radially spaced from the housing axis directly in the air stream flow, and portions of the body elements or vanes are heated to prevent freezing of the water in and adjacent to the mixing chambers and nozzles.

10 Claims, 2 Drawing Sheets

NUCLEATOR ASSEMBLY FOR SNOWMAKING APPARATUS

BACKGROUND OF THE INVENTION

There is a considerable body of prior art in the design of fan-type snowmaking apparatus wherein a high velocity stream of subfreezing ambient air is forced through a tubular housing from an open inlet to a coaxial outlet where water is sprayed into the air stream. This mixture of water and air propelled from the outlet end of the tubular housing is especially effective in making artificial snow if a nucleating device is provided in the tubular housing upstream of the water injection at the outlet end. A nucleating device sprays a mixture of fine droplets of water and pressurized air into the main air stream flowing through the tubular housing by air displacement means such as a motor-driven fan. The minute droplets of water generated by the nucleator attract moisture to form larger crystals more closely comparable to natural snow.

The most common conventional location for a nucleator nozzle is on the central axis of the tubular housing downstream of the fan, as exemplified by the designs in U.S. Pat. Nos. 3,733,029, 3,945,567 and 4,813,598. The fan or other air displacement means in such a configuration typically includes a drive motor coaxial with the fan axis, usually with some form of cowling over the motor, and a nucleator disposed coaxially downstream of that apparatus is necessarily in its lee so that the nucleator is not directly in the highest velocity air stream flow where its seeding of ice crystal nuclei can be most effective.

In U.S. Pat. No. 5,167,367 a design is disclosed wherein a multiple-orifice nucleator is located at a six o'clock position upstream of the water injection means instead of on the axis of the tubular housing, but even in that design the nucleator orifices are on the leeward side of a reservoir component tilted at an angle facing downstream, and hence are not directly in the air stream flow. A circular array of nucleator nozzles concentric with and spaced radially from the tubular housing axis is shown in U.S. Pat. No. 5,180,106 but they are completely shielded from the air stream flow by a fixed central cylindrical shroud.

To locate nucleator nozzles radially away from the axis of the tubular housing directly in the subfreezing air stream flow, and not in the protective lee of the coaxial fan and motor or some shroud such as that required in U.S. Pat. No. 5,180,516, can create serious icing problems. When compressed air mixes with water in the nucleator nozzle a subfreezing air stream impinging directly upon the nucleator may very well cause the water component in the nucleator to form rime ice which can clog the nucleator nozzle.

It is a principal purpose of the present invention to provide a nucleator assembly which will be located at a region of maximum effectiveness directly within the cold air stream flow through the tubular housing, and not in the lee of any upstream fan motor or shroud, and which enhances the mixing of air and water in the nucleator while preventing freezing of the water as it mixes with the air. Motionless mixers are well known for enhancing the mixing of certain viscous fluids, as taught for example in U.S. Pat. Nos. 4,840,903 and 4,850,705, but those devices generally are applicable to the mixing of viscous fluids in plastic injection molding processes or epoxy and resin static mixers. Motionless mixers of that form have not previously been utilized for water and air mixing in nucleators for snowmaking equipment.

SUMMARY OF THE INVENTION

The invention provides a nucleator assembly for snowmaking apparatus wherein an extended tubular housing has opposite coaxial inlet and outlet ends with air displacement means mounted within the housing remote from its outlet end for forcing an air stream through the housing and with water injection means downstream from the air displacement means for ejecting water into the air stream. The nucleator assembly includes at least one body element downstream from the air displacement means fixed radially with respect to the housing axis and having upstream and downstream portions. This body element defines at least one internal mixing chamber and respective air and water supply bores adapted to communicate said chamber with external sources of pressurized air and water respectively. On the downstream portion of the body element is a nozzle spaced radially from the housing axis to be directly in the air stream flow and communicating with the mixing chamber for ejecting an admixture of pressurized air and water into the air stream. Turbulence-creating mixing means are included within the mixing chamber for enhancing the mixing of the air and water ejected through the nozzle. Means are provided for preventing freezing of the water mixed with the air within and adjacent to the nozzle.

The body element is preferably radially disposed with respect to the housing axis and is upstream of the water injection means. The body element may be fixed at one end to the inside of the housing and at the other end to an axial diffuser extending downstream from the air displacement means. A plurality of body elements may be included spaced equally angularly apart radially around the housing axis.

In a preferred form of the invention the mixing chamber is elongated and the turbulence-creating mixing means is a removable elongated twisted motionless mixer unit inserted within the mixing chamber to enhance the mixing of the air and water ejected through the associated nozzle. For the freeze prevention means, a removable electrical heating cartridge may be mounted within a cartridge-receiving bore within the body element.

The body element is preferably in the form of a flat vane having upstream and downstream edge portions. The vane may have flat sides disposed parallel to the direction of the air stream flow and its upstream and downstream edges may be substantially narrower than said flat sides and tapered to present minimal resistance to the air stream flow. A thermal barrier slot may extend into the vane from its downstream edge portion between its mixing chamber and the housing axis to prevent heat conduction beyond that portion of the vane which includes the mixing chamber and nozzle.

DESCRIPTION OF PREFERRED EMBODIMENT

Figure 1:
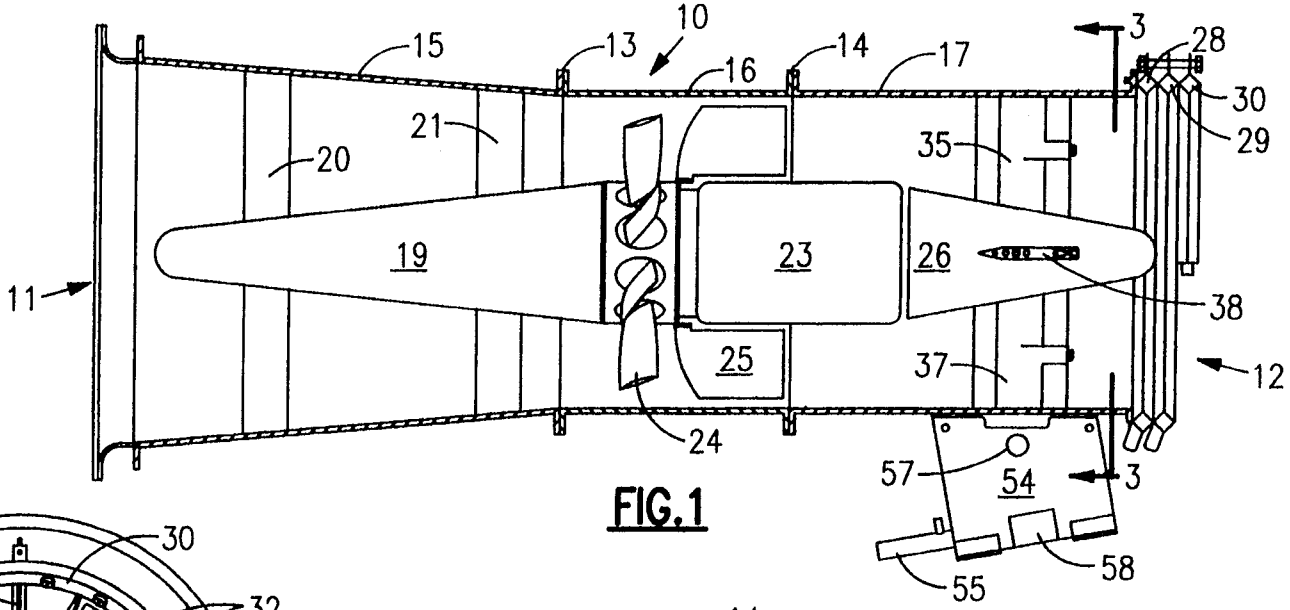
FIG. 1 is a longitudinal elevation of snowmaking apparatus equipped with the nucleator assembly of the invention with the tubular housing in half section to show the internal components of the apparatus.
Figure 3:
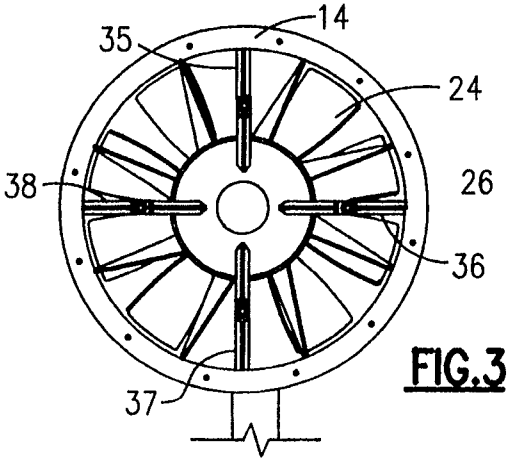
FIG. 3 is a lateral section taken along the line 3—3 of FIG. 1.
Figure 2:
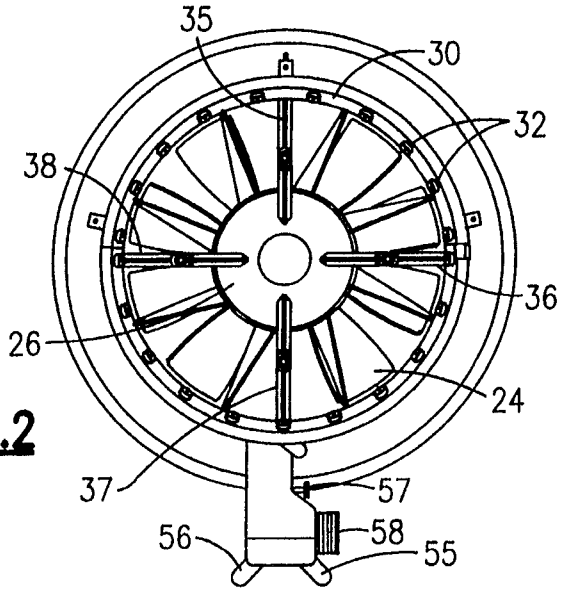
FIG. 2 is an end view of the outlet end of the apparatus of FIG. 1.

Referring first to FIGS. 1 to 3 the snowmaking apparatus of the invention includes an extended tubular housing 10 having an inlet end 11 and an opposite coaxial outlet end 12. The housing 10 may be formed in three sections joined at flanges 13 and 14 to include an upstream converging inlet section 15, a relatively short cylindrical central section 16 and a somewhat longer outlet section 17. Suitable grating means may be provided across the inlet end 11 to prevent entry of foreign objects into the tubular housing 10.

Mounted coaxially principally within the inlet section 15 of the housing 10 is a fixed conical inlet diffuser 19 supported in place by appropriate radial ribs 20 and 21. Coaxially mounted by suitable radial supports (not shown) between the central section 16 and the outlet section 17 of the tubular housing 10 is an electric motor 23 which drives a fan 24 adapted to force a stream of sub-freezing ambient air through the tubular housing 10 from the inlet end 11 through the outlet end 12. It is known in the design of fan-type snowmaking apparatus to remove some blades of the fan 24 to render it asymmetrical and then balance the fan by appropriate weights applied elsewhere to rotating parts, all for the purpose of reducing noise emitted during operation. Conventional flow control fins 25 may be provided immediately downstream of the fan 24.

Extending coaxially from the downstream end of the motor 23 is a downstream conical diffuser 26 which ends approximately at the outlet end 12 of the housing 10. Encircling that outlet end of the housing 10 are water ejection means for ejecting water into the air stream forced through the housing 10. This may comprise two complete circular tubular headers 28 and 29 and one smaller header 30 describing a half circle. The headers 28 to 30 are supplied with water, under pressure from a source mentioned hereinafter, which is ejected through a multiplicity of nozzles 32 spaced equally angularly apart around the respective headers. Some of those nozzles 32 are shown in FIG. 2.

Figure 4:
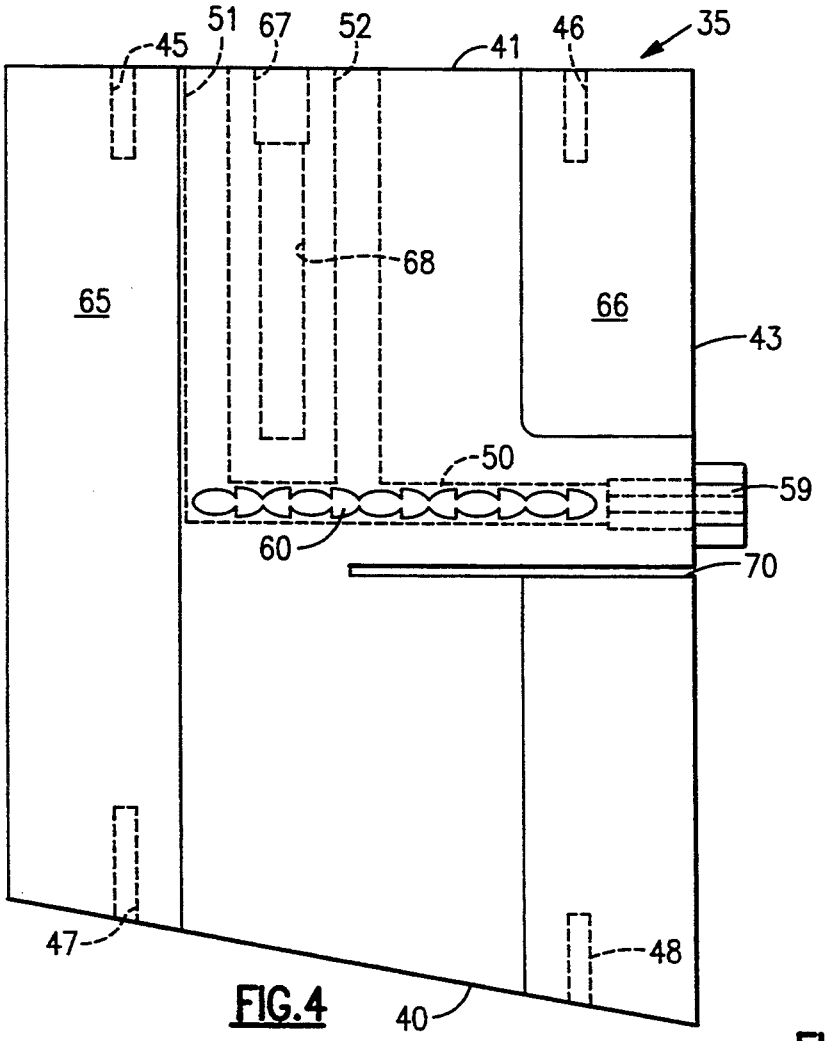
FIG. 4is an enlarged side elevation of one of the body elements or vanes of the nucleator assembly of the invention.

In accordance with the invention a nucleator assembly is included for introducing a spray of water into the cold air stream to provide nuclei for the formation of ice crystals when mixed with the water ejected at the nozzles 32. This nucleator assembly includes four radially disposed vanes 35, 36, 37 and 38, preferably of aluminum, shown in FIGS. 1 to 3. These four vanes are spaced equally angularly apart around the housing axis downstream from the air displacement means. One end of each vane is fixed to the inside of the outlet section 17 of the tubular housing 10 and the other end is fixed to and supports the downstream diffuser 26. As shown in FIG. 4 that edge of each vane 35 to 38 closest to the axis of the housing 10 is angled to conform to the conical shape of the downstream diffuser 26.

Figure 5:
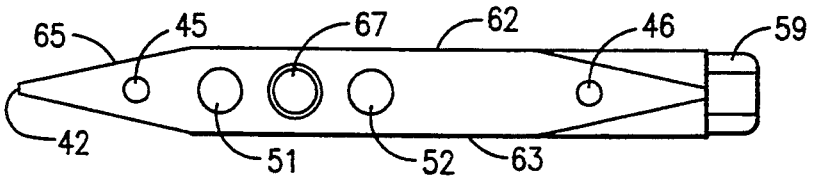
FIG. 5 is a top plan view of the body element or vane of FIG. 4.
Figure 6:
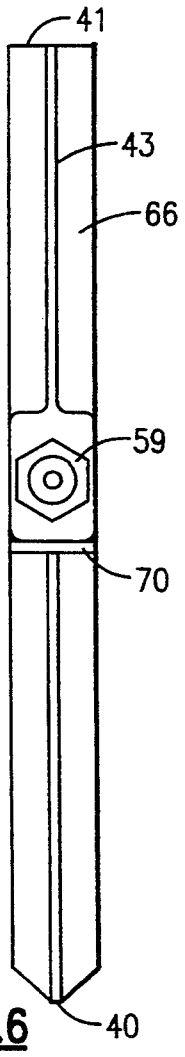
FIG. 6 is an end elevation of the downstream edge portion of the vane of FIG. 4.

Turning now to FIGS. 4 to 6 the vane 35 is shown in more detail. The edge 40 is the aforementioned angled edge and it is opposite edge 41 which is affixed to the inside of the outlet section 17 of the housing 10. The vane 35 also includes an upstream edge portion 42 and a downstream edge portion 43.

The vane 35, like the vanes 36 to 38, has formed in its edge 41 a pair of threaded bores 45 and 46 for receiving fastening screws attaching it to the housing 10. Similarly its angled edge 40 is formed with threaded bores 47 and 48 for receiving fastening screws to secure it to the downstream diffuser 26.

Each vane defines an elongated interior mixing chamber 50 which is a blind hole opening at the downstream edge 43 of the vane. Transverse to the mixing chamber 50 is a water supply bore 51 communicating with the inner end of the mixing chamber 50 and opening on the edge portion 41 of the vane 35. Also, there is formed in the vane 35 a transverse air supply bore 52 which also communicates with the mixing chamber 50 and opens on the edge portion 41 of the vane 35. The bores 51 and 52 are connected by means not shown to a valving unit 54 on the underside of the outlet section 17 of the tubular housing 10 and thence by respective water and air lines 55 and 56 shown in FIG. 2 to appropriate external sources of pressurized water and air. Typical air flow may be at about 70 psig and water flow at about 400 psig. By means of a valve control 57 the flow of water may be varied to vary the ratio of water to air in the mix entering the mixing chamber 50 of the various vanes. Triple water supply nipples 58 are associated with the valving unit 54 for conduit connection to the three headers 28 to 30.

The mixture of water and air created in the mixing chamber 50 is ejected forcibly through a nozzle 59 on the downstream edge portion 43 of each vane. The orifice of the nozzle 59 is spaced radially from the central axis of the tubular housing 10 to be directly in the annular airstream flowing around the motor 23 and the downstream diffuser 26. The nozzle 59 is threaded into a socket formed in the downstream end of the mixing chamber 50. Before it is threaded in place an elongated turbulence-creating removable twisted motionless mixer unit 60 is inserted within the mixing chamber 50 for enhancing the mixing of the air and water. A preferred form of such a twisted motionless mixer unit is that shown and described in detail in the aforementioned U.S. Pat. Nos. 4,840,493 and 4,850,705 and it is commercially available. Its use heretofore has not extended to the mixing of water and air in snowmaking apparatus.

Each of the vanes has flat sides 62 and 63 disposed parallel to the direction of the air stream flow, the upstream and downstream edge portions 42 and 43 being substantially narrower than the flat sides 62 and 63. Also, the flat sides 62 and 63 include a tapered upstream edge portion 65 and a tapered downstream edge portion 66 to present minimal resistance to the air stream flow.

As noted previously, formation of rime ice adjacent the nozzles 59 is possible from the sub-freezing temperature of ambient air forced through the tubular housing 10 unless measures are taken to prevent such freezing. In accordance with the invention a removable electric cartridge 67 of a type which is commercially available is mounted in a cartridge-receiving bore 68 within the vane 35 generally adjacent the mixing chamber 50. The cartridge heats the region of the chamber 35 around the mixing chamber and adjacent the nozzle 59 to prevent that formation of rime ice. Also, to confine the heating effect to the desired area in the vane 35 a thermal barrier slot 70 extends into the vane 35 from its downstream edge portion 33 between the mixing chamber 50 and the housing axis. This prevents heat conduction beyond that portion of the vane 35 which includes the mixing chamber 50 and the nozzle 59.

In operation the motor 23 drives the fan 24 to force a high-velocity stream of air through the housing 10 into which water is sprayed from the nozzles 32 at the outlet end of the housing. The air stream proceeds in an annular flow over the motor 23 and the downstream diffuser 26 and passes directly over the nucleator vanes 35 to 38. Air and water under pressure are thoroughly mixed by the twisted motionless mixing unit 60 in the mixing chamber 50 and emerge from the nozzle 59 in a particularly fine spray to provide optimum nucleation for formation of large ice crystals closely resembling natural snow. In doing so, notwithstanding exposure to subfreezing ambient air, no rime ice forms on the nozzles 59 because of the heating affect of the cartridge heater 67.

Various modifications can be made in the foregoing structure and embody the inventive concept. For example, the vanes 35 to 38 need not be radially disposed since it is necessary only that their nozzles 59 be spaced radially from the axis of the housing 10 directly within the air stream. Also there may be more than one array of the vanes 35 longitudinally spaced along the housing axis. The vanes need not be joined to the downstream diffuser 26 but could be joined together at the axis of the housing 10. While the flat shape of the vanes described hereinbefore is certainly preferred, their cross section could be varied.

The scope of the invention is to be determined from the following claims rather than from the foregoing description of a preferred embodiment.

I claim:

1. In snowmaking apparatus wherein an extended tubular housing has opposite coaxial inlet and outlet ends with air displacement means mounted within the housing remote from its outlet end for forcing an air stream through the housing and with water injection means downstream from the air displacement means for ejecting water into said air stream, a nucleator assembly comprising a) at least one body element downstream from the air displacement means fixed with respect to the housing axis and having upstream and downstream portions, b) said body element defining at least one interior mixing chamber and respective air and water supply bores adapted to communicate said chamber with external sources of pressurized air and water respectively, c) a nozzle on the downstream portion of the body element spaced radially from the housing axis to be directly in the air stream flow and communicating with the mixing chamber for ejecting an admixture of pressurized air and water into the air stream, d) turbulence-creating mixing means within said mixing chamber for enhancing the mixing of the air and water ejected through the nozzle, and e) means for preventing freezing of the water mixed with the air within and adjacent to said nozzle.

2. A nucleator assembly according to claim 1 wherein the body element is radially disposed with respect to the tubular housing axis and is upstream of the water injection means.

3. A nucleator assembly according to claim 2 wherein the body element is fixed at one end to the inside of the housing and at the other end to an axial diffuser extending downstream from the air displacement means.

4. A nucleator assembly according to claim 1 wherein the body element is a vane having upstream and downstream edge portions.

5. A nucleator assembly according to claim 4 wherein the vane has flat sides disposed parallel to the direction of the air stream flow and its upstream and downstream edges are substantially narrower than said flat sides and are tapered to present minimal resistance to the air stream flow.

6. A nucleator assembly according to claim 4 wherein a plurality of vanes are included spaced equally angularly apart radially around the housing axis.

7. A nucleator assembly according to claim 1 which includes a thermal barrier slot extending into the vane from its downstream edge portion between its mixing chamber and the housing axis to prevent heat conduction beyond that portion of the vane which includes the mixing chamber and nozzle.

8. A nucleator assembly according to claim 1 wherein the mixing chamber is elongated and the turbulence-creating mixing means is a removable elongated twisted motionless mixer unit inserted within the mixing chamber for enhancing the mixing of the air and water ejected through the associated nozzle.

9. A nucleator assembly according to claim i wherein the means for preventing freezing comprises a removable electric heating cartridge mounted within a cartridge-receiving bore within the body element.

10. In snowmaking apparatus wherein an extended tubular housing has opposite coaxial inlet and outlet ends with air displacement means mounted within the housing remote from its outlet end for forcing an air stream through the housing and with water injection means downstream from the air displacement means for ejecting water into said air stream, a nucleator assembly comprising a) a plurality of vanes spaced equally angularly apart around the housing axis downstream from the air displacement means and upstream of the water injection means, each vane being fixed radially with respect to the housing axis and having upstream and downstream edge portions;

b) each of said vanes defining at least one elongated interior mixing chamber and respective air and water supply bores adapted to communicate said chamber with external sources of pressurized air and water respectively, each vane having flat sides disposed parallel to the direction of the air stream flow with its upstream and downstream edge portions being substantially narrower than said flat sides and being tapered to present minimal resistance to the air stream flow;

c) a nozzle associated with each mixing chamber on the downstream edge portion of each vane spaced radially from the housing axis to be directly in the air stream flow and communicating with the mixing chamber for ejecting an admixture of pressurized air and water into the air stream;

d) an elongated turbulence-creating removable twisted motionless mixer unit inserted within each mixing chamber for enhancing the mixing of the air and water ejected through the associated nozzle;

e) a removable electric heating cartridge mounted in a cartridge-receiving bore within each vane adjacent each mixing chamber and nozzle for preventing freezing of the water mixed with the air within and adjacent to the associated nozzle; and f) a thermal barrier slot extending into each vane from its downstream edge portion between its mixing chamber and the housing axis to prevent heat conduction beyond that portion of the vane which includes the mixing chamber and nozzle.

* * * * *